US005591352A

United States Patent [19]

Peng

[11] Patent Number: 5,591,352

[45] Date of Patent: Jan. 7, 1997

[54] HIGH RESOLUTION COLD CATHODE FIELD EMISSION DISPLAY METHOD

[75] Inventor: Chao-Chi Peng, Chinchu, Taiwan

[73] Assignee: Industrial Technology Research Institute, Hsinchu, Taiwan

[21] Appl. No.: 429,730

[22] Filed: Apr. 27, 1995

[51] Int. Cl.[6] ..... B44C 1/22

[52] U.S. Cl. ..... 216/11; 216/25; 216/38; 216/56

[58] Field of Search ..... 216/2, 11, 24, 216/25, 38, 52, 56; 156/636.1, 645.1; 445/25; 313/336

[56] References Cited

U.S. PATENT DOCUMENTS

| | | | |
|---|---|---|---|
| 4,940,916 | 7/1990 | Borel et al. | 313/306 |
| 5,142,184 | 8/1992 | Rane | 313/309 |
| 5,194,780 | 3/1993 | Meyer | 315/169 |
| 5,229,331 | 7/1993 | Doan et al. | 216/11 |
| 5,494,179 | 2/1996 | Hori et al. | 216/11 |

*Primary Examiner*—William Powell
*Attorney, Agent, or Firm*—George O. Saile

[57] ABSTRACT

The object of the present invention is to provide a cold cathode field emission display whose resolution is not limited by the provision of individual ballast resistors for each pixel or by the wiring system used to deliver voltage to the cold cathodes. This has been achieved by providing additional layers beneath the cold cathodes arrays so that said resistors and voltage delivery systems are located directly below the cold cathode arrays instead of alongside of them. Six different embodiments of the invention are described.

2 Claims, 7 Drawing Sheets

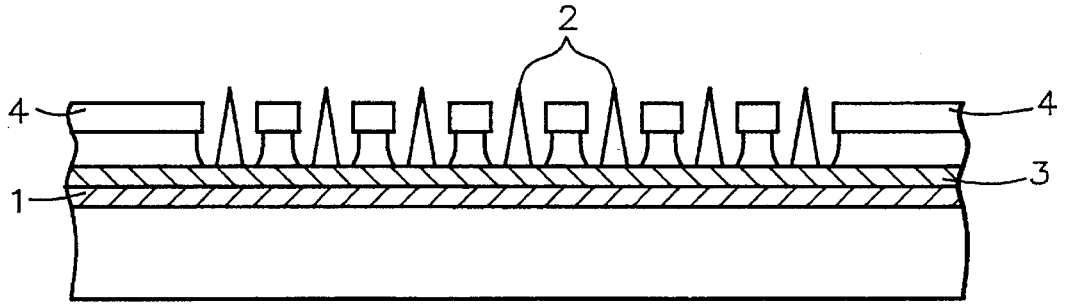
FIG. 1 – Prior Art
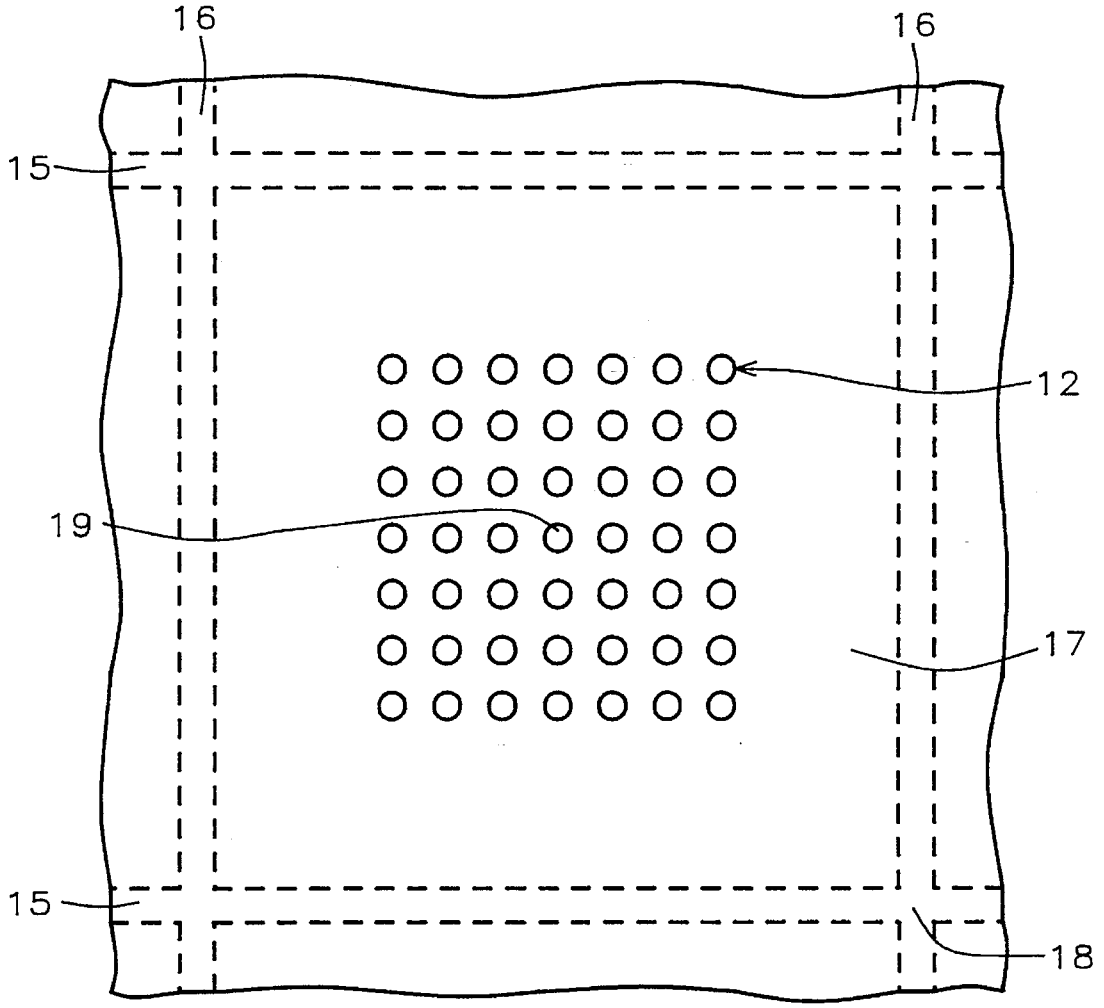
FIG. 2 – Prior Art

HIGH RESOLUTION COLD CATHODE FIELD EMISSION DISPLAY METHOD

BACKGROUND OF THE INVENTION (1) Field of the Invention

The invention relates to cold cathode field emission displays, more particularly high resolution field emission displays.

(2) Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line (or column). Another set of conductive lines (called gate lines) is located a short distance above the cathode columns at an angle (usually 90°) to them, intersecting with them at the locations of the conical emitters or microtips, and connected to a source of positive voltage. Both the cathode and the gate line that relate to a particular microtip must be activated before there will be sufficient voltage to cause cold cathode emission.

The electrons that are emitted by the cold cathodes accelerate past openings in the gate lines and strike an electroluminescent panel that is located a short distance above the gate lines. In general, even though the local electric field in the immediate vicinity of a microtip is in excess of 1 million volts/cm., the externally applied voltage is only of the order of 100 volts. However, even a relatively low voltage of this order can obviously lead to catastrophic consequences, if short circuited.

The early prior art in this technology used external resistors, placed between the cathode or gate lines and the power supply, as ballast to limit the current in the event of a short circuit occurring somewhere within the display. While this approach protected the power supply, it could not discriminate between individual microtips on a given cathode column or gate line. Thus, in situations where one (or a small number) of the microtips is emitting more than its intended current, no limitation of its individual emission is possible. Such excessive emission can occur as a result of too small a radius of curvature for a particular microtip or the local presence of gas, particularly when a cold system is first turned on. Consequently the more recent art in this technology has been directed towards ways of providing individual ballast resistors, preferably one per pixel.

The approach favored by Borel et al. (U.S. Pat. No. 4,940,916 July 1990) is illustrated in FIG. 1. This shows a schematic cross-section through a single pixel. As already discussed, current to an individual microtip 2 is carried by a cathode line 1 and a gate line 4. However, a high resistance layer 3 has been interposed between the base of the microtip and the cathode line, thereby providing the needed ballast resistor. While this invention satisfies the objective of providing each microtip with its own ballast resistor, as well as not reducing the resolution of the display, it has a number of limitations.

The resistivity that layer 3 will need in order to serve as a ballast resistor is of the order of $5\times10^4$ ohm cm. This significantly limits the choice of available materials. Furthermore, sustained transmission of current across a film is substantially less reliable than transmission along a film. The possibility of failure as a result of local contamination or local variations in thickness is much greater for the first case. Consequently, later inventions have focussed on providing individual ballast resistors wherein current flows along the resistive layer, rather than across it.

Kane (U.S. Pat. No. 5,142,184 August 1992) used semiconductor integrated circuit technology to generate his cold cathode display so that individual ballast resistors could be provided in the same way that resistors are provided within integrated circuits in general. This approach meets the requirement of current transmission along, rather than across, the resistive layer but makes for a more expensive system since an additional mask and diffusion step are required. Furthermore, additional space must be made available for the diffused resistors, which lie on either side of the cathode columns, thereby decreasing the resolution of the system.

The approach taken by Meyer (U.S. Pat. No. 5,194,780 Mar. 1993) utilizes a cathode distribution mesh and is illustrated in FIG. 2. This shows, in plan view, a portion of a single cathode line which, instead of being a continuous sheet, has been formed into a network of lines 15 intersecting with lines 16. A resistive layer 17 has been interposed between the mesh and the substrate (not shown here). Microtips 12 have been formed on the resistive layer and located within the interstices of the mesh. A single gate line intersects the cathode distribution mesh, and current from the mesh must first travel along resistive layer 17 before it reaches the microtips. An important disadvantage of this approach is that the presence of the mesh limits the resolution of the display. Another disadvantage is that the values of the ballast resistors associated with the various microtips vary widely because of the geometry of this design.

SUMMARY OF THE INVENTION

It has been an object of the present invention to provide a cold cathode field emission display whose resolution is not limited by the provision of individual ballast resistors for each pixel or by the wiring system used to deliver voltage to the cold cathodes.

A further object of the invention has been to provide individual ballast resistors that have high reliability and are capable of meeting tight tolerances.

These objects have been achieved by providing additional layers beneath the cold cathodes arrays so that said resistors and voltage delivery systems may be located directly below the cold cathode arrays instead of alongside of them. Six different embodiments of the invention are described.

BRIEF DESCRIPTION OF THE DRAWINGS

FIGS. 1 and 2 illustrate prior art that teaches the technology of built-in ballast resistors for cold cathode displays.

DESCRIPTION OF THE PREFERRED EMBODIMENTS

The present invention is aimed at providing individual ballast resistors for the groups of microtips that comprise pixels without sacrificing the resolution of the overall display. This has been achieved by placing the ballast resistors and cathode voltage supply system (cathode columns or distribution mesh) underneath the microtips instead of alongside them.

Figure 3A:
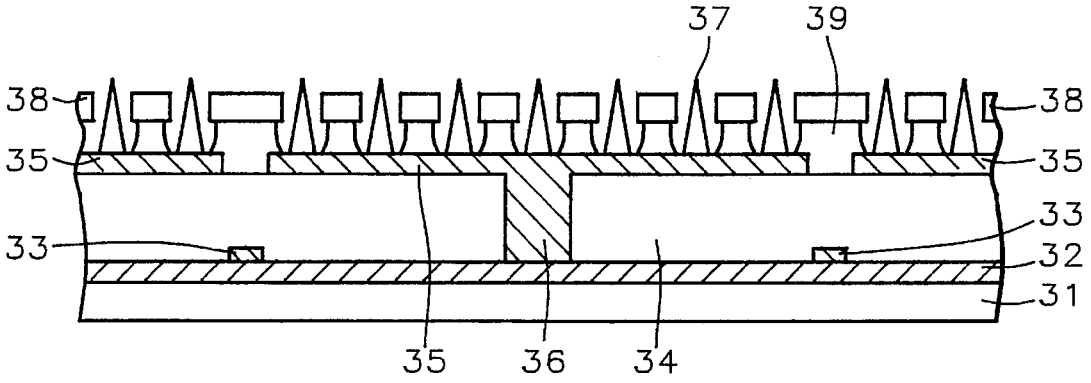
FIGS. 3A and B show a first embodiment of the invention based on a distributed ballast resistor and a cathode distribution mesh.

Referring now FIG. 3A. This shows, in schematic cross-section, a first embodiment of the present invention. Resistive layer 32 has been deposited onto insulating substrate 31. Cathode distribution mesh 33 (seen end-on in the figure) sits above, beneath, or in, and makes contact with, resistive layer 32. Dielectric layer 34 has been deposited over layers 32 and 33 and cathode column 35 (seen end-on) lies over layer 34. Via hole 36 allows material from layer 35 to make contact with resistive layer 32. Microtips such as 37 rest on cathode column 35 and extend through openings in gate line 38 which is separated from layer 35 by second dielectric layer 39. Note that it is necessary to planarize the upper surface of layer 35 prior to the placement of the microtips. We have found the most effective way to achieve this to be by means of Chemical Mechanical Polishing (CMP). The CMP process comprises the application of a chemical etchant, which loosens the surface, in combination with a fine abrasive slurry that removes the modified surface as it is undermined.

Figure 3B:
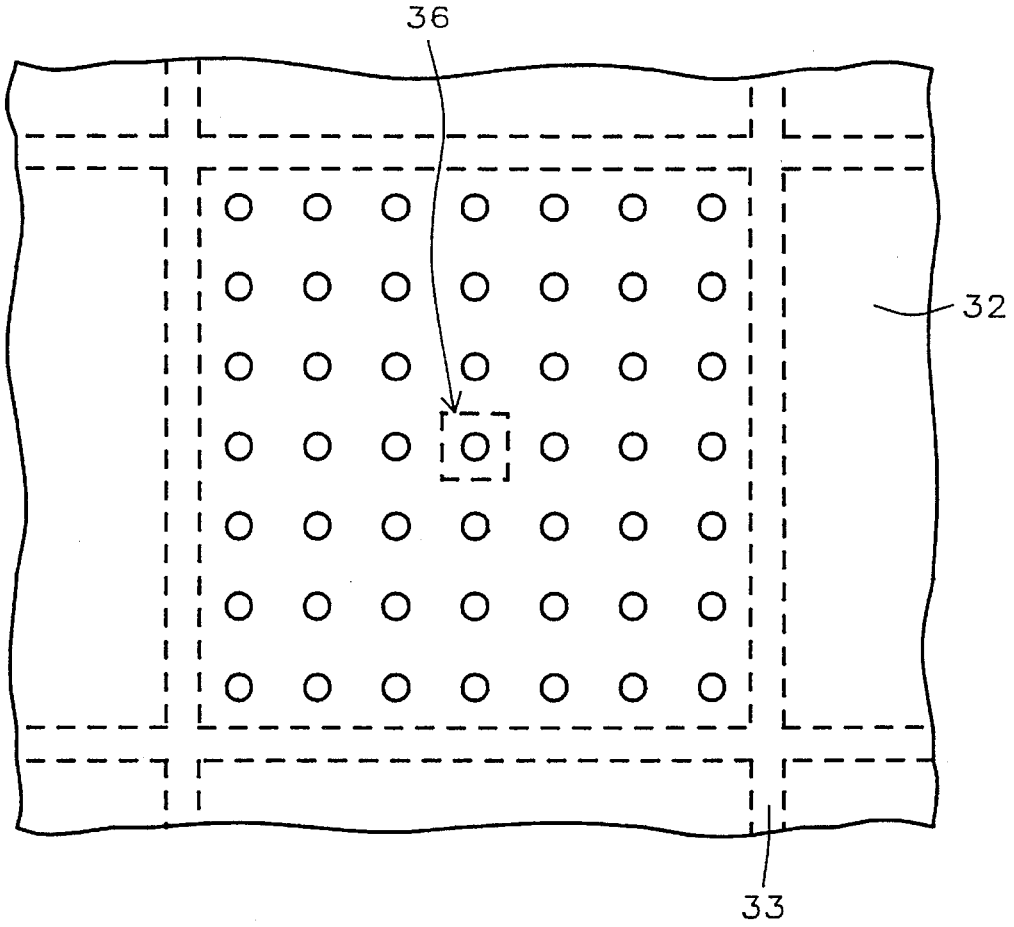

FIG. 3B is a partial plan view of the structure illustrated in FIG. 3A. It is readily apparent that, other things being equal, the structure of FIG. 3B can be made smaller than the prior art structure illustrated in FIG. 2. The size of cathode distribution mesh 18 in FIG. 2 is limited by how close lines 15 and 16 can come to the array of microtips (such as 12) and still provide adequate resistance in series with them. Furthermore, the closer lines 15 and/or 16 come to microtip 12 the greater will be the disparity in ballast resistor values associated with these two microtips. By contrast, all microtips in FIGS. 3 are associated with the same value of ballast resistance and the size of the cathode distribution mesh can be reduced to less than that of the cathode columns, eliminating it as a factor in limiting the overall resolution.

Preferred materials for manufacturing this embodiment have included silicon, silicon/chrome alloy, indium tin oxide, and tantalum nitride for the resistive layer, laid down to provide a sheet resistance in the range of from $10^7$ to $10^3$ ohms/square and silicon oxide, aluminum oxide, silicon nitride, iron oxide, indium oxide, stannous oxide, and tantalum oxide for the dielectric layers.

Figure 4A:
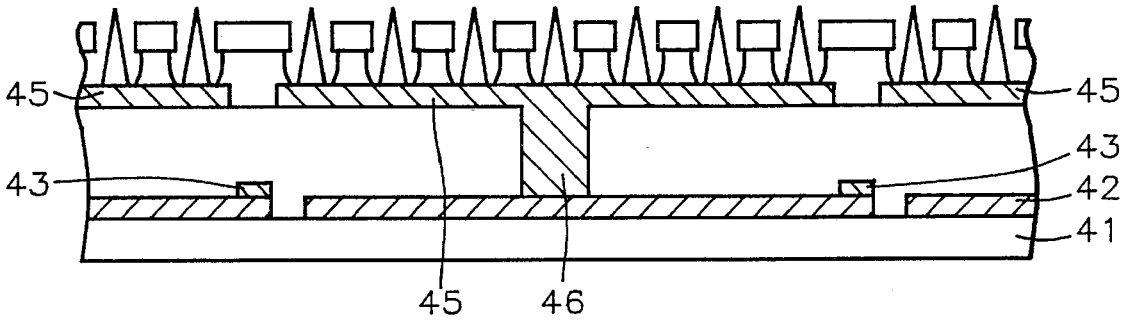
FIGS. 4A and B show a second embodiment of the invention based on a serpentine thin film resistor and a cathode distribution line.
Figure 4B:
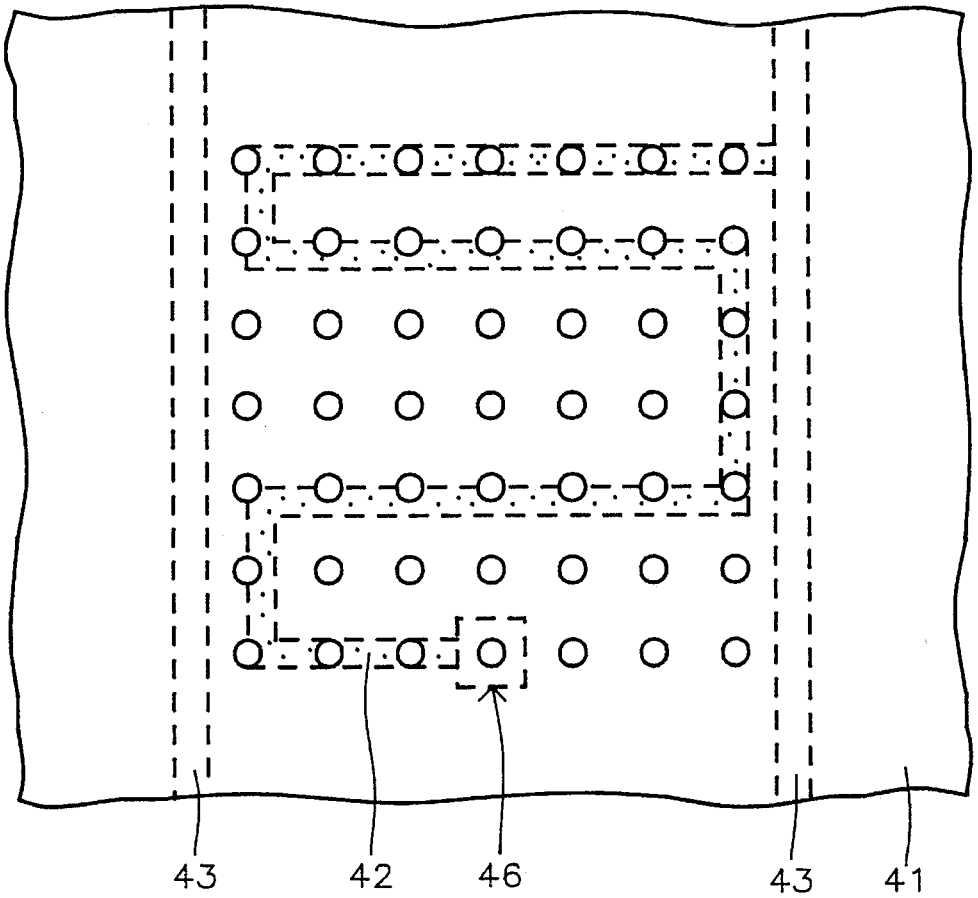

FIG. 4A is a schematic cross-section of a second embodiment of the present invention in which a more conventional aspect ratio for the ballast resistor has been used. Resistor 42 is a thin film resistor that has been deposited and patterned on substrate 41. One end of each resistor is connected to a cathode distribution line such as 43 (seen end-on) while the other end is connected to a cathode column (also seen end-on) through via hole 46. FIG. 4B is a plan view of part of FIG. 4A.

This embodiment makes the value of the ballast resistor easier to control and allows resistive layers having lower sheet resistance to be used. Also, since only a single line is needed for the voltage supply (as opposed to the multiple lines of a mesh), this embodiment occupies less space than the embodiment illustrated in FIG. 3.

Figure 5:
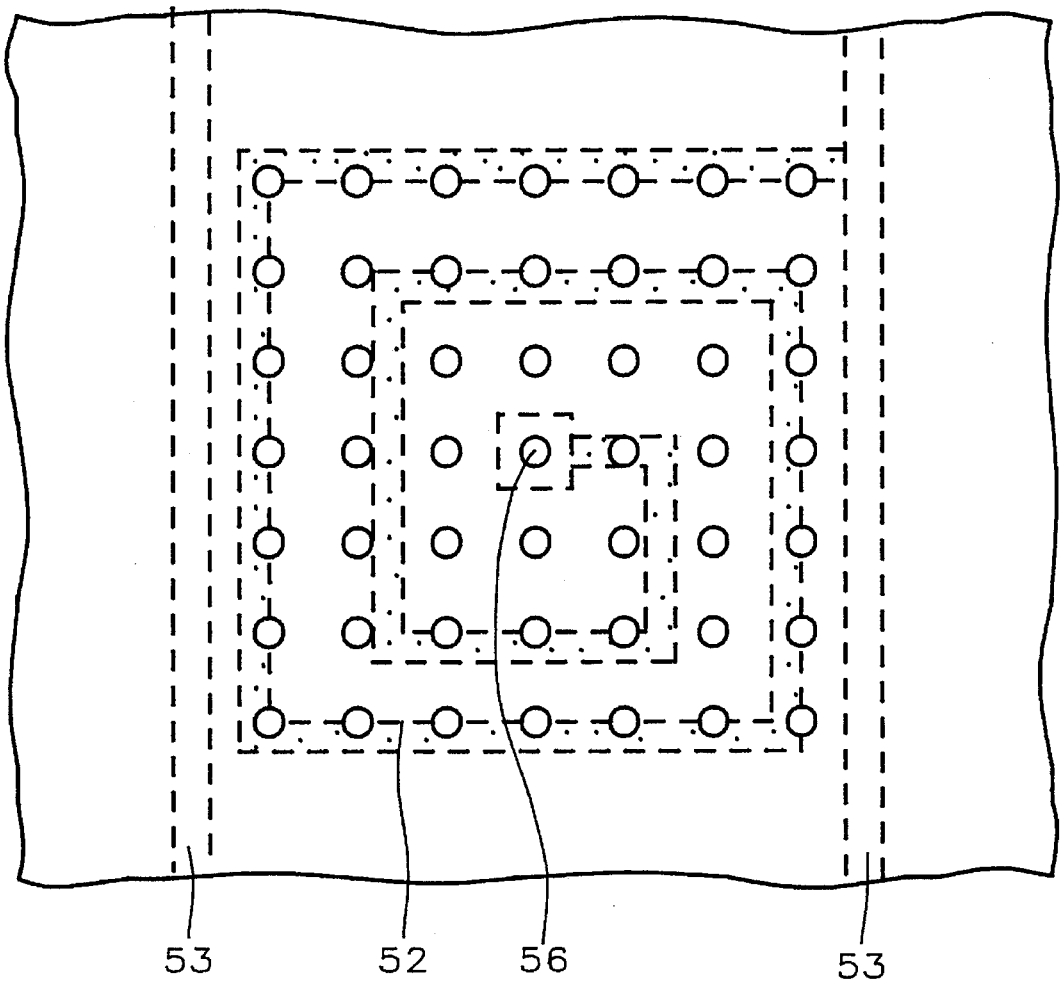
FIG. 5 shows a third embodiment of the invention based on a spiral thin film resistor and a cathode distribution line.

FIG. 5 is a plan view of a third embodiment that is a variant of the embodiment illustrated in FIGS. 4. In FIG. 4 the resistor followed a serpentine path in going from the cathode distribution line to the via hole. In FIG. 5, the path of resistor 52 can be seen to be a spiral that begins at the cathode distribution line 53 and then spirals inwards till it reaches the via hole 56 at the center.

Preferred materials for manufacturing this embodiment have included silicon, silicon/chrome alloy, indium tin oxide, and tantalum nitride for the resistive layer, laid down to provide a sheet resistance in the range of from $10^7$ to $10^9$ ohms/square and silicon oxide, aluminum oxide, silicon nitride, iron oxide, indium oxide, stannous oxide, and tantalum oxide for the dielectric layers.

Figure 6A:
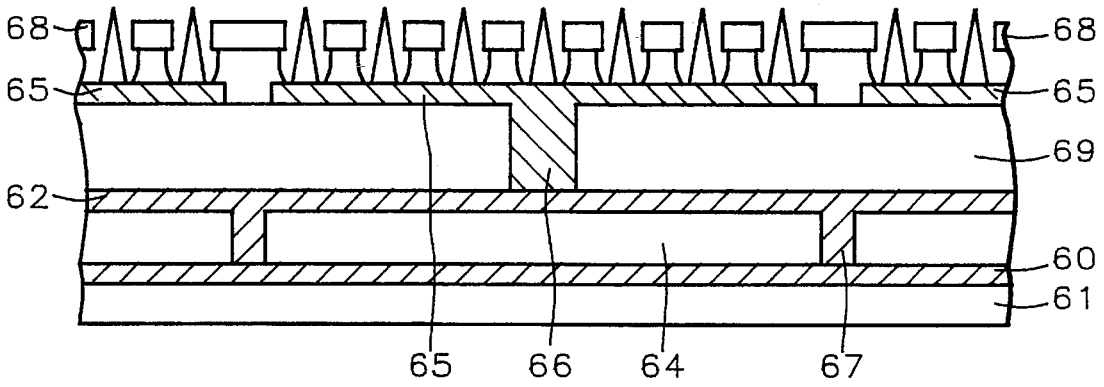
FIGS. 6A and B show a fourth embodiment of the invention based on a distributed ballast resistor and a cathode distribution plane.
Figure 6B:
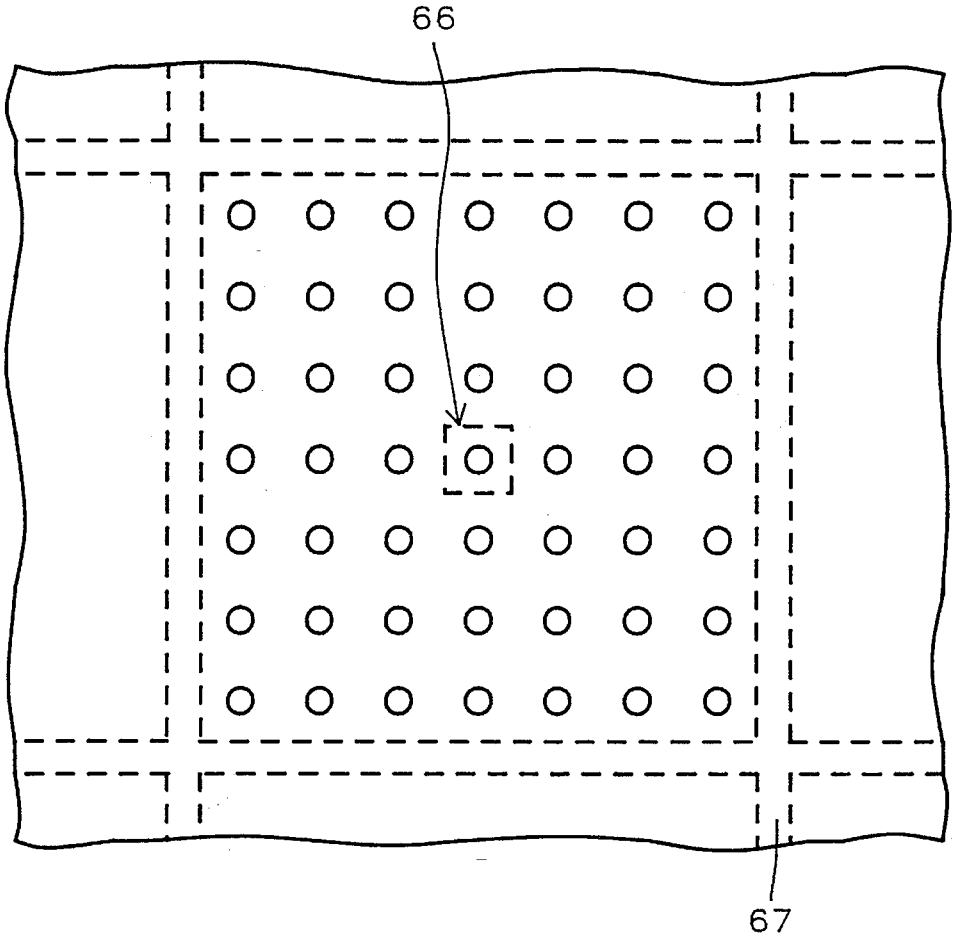
Figure 7A:
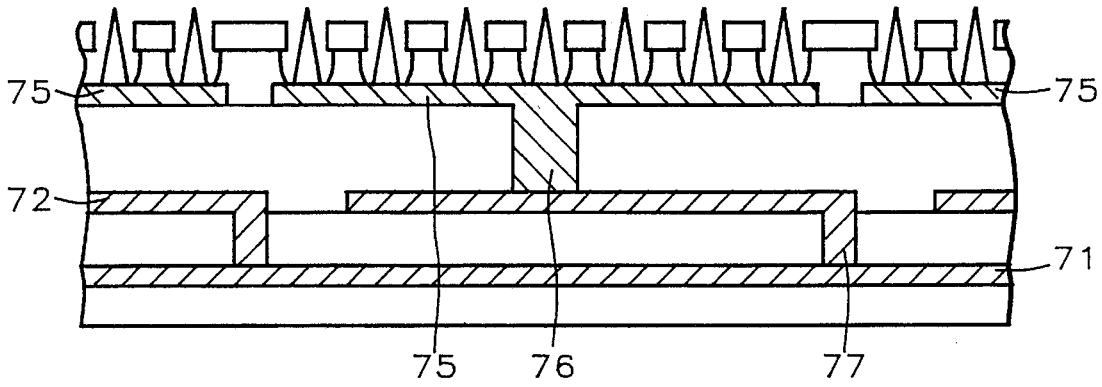
FIGS. 7A and B show a fifth embodiment of the invention based on a serpentine thin film resistor and a cathode distribution plane.
Figure 7B:
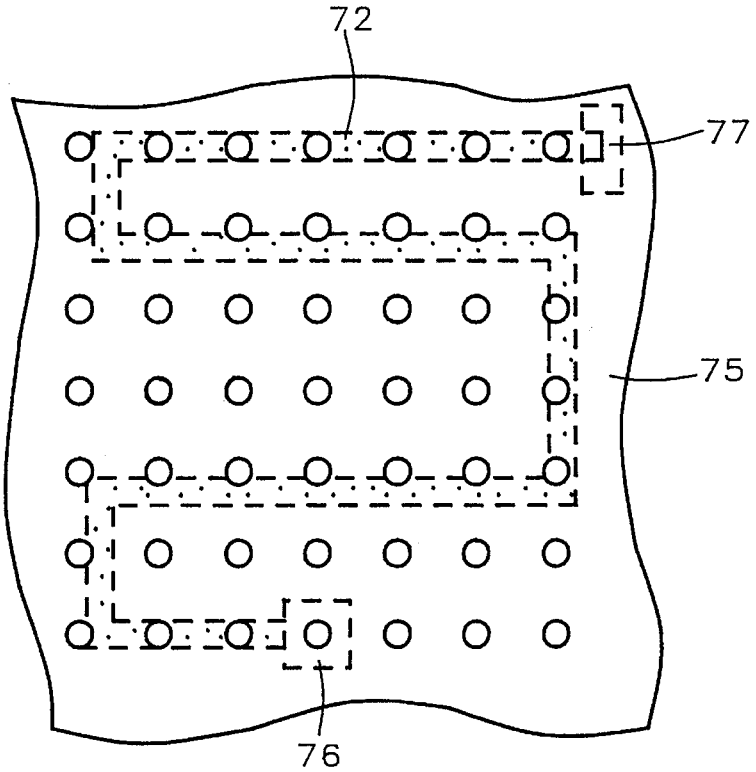
Figure 8A:
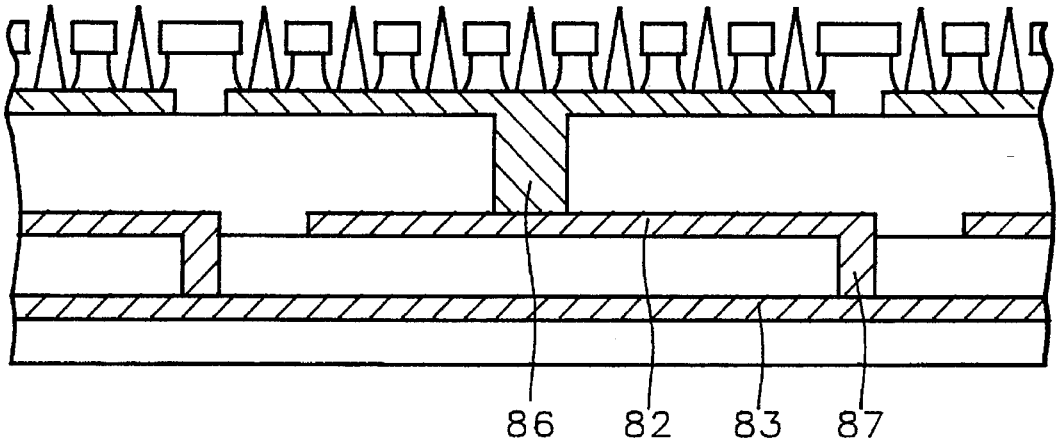
FIGS. 8A and B show a sixth embodiment of the invention based on a spiral thin film resistor and a cathode distribution plane.
Figure 8B:
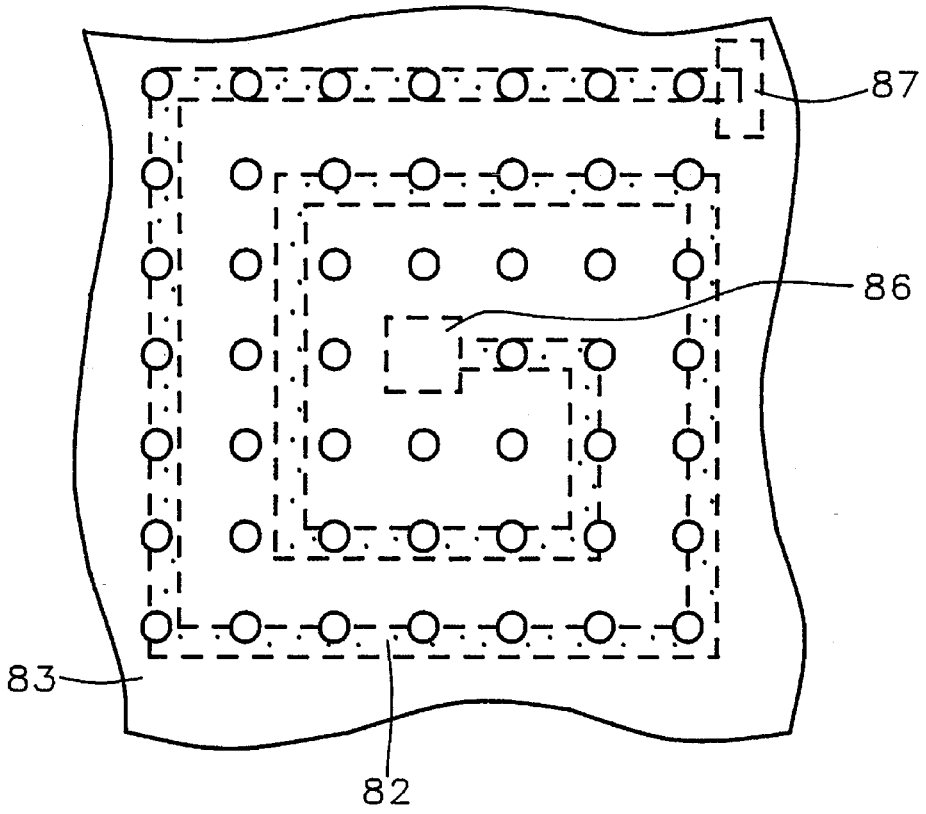

FIG. 6A shows a schematic cross-section of a fourth embodiment of the present invention. Conductive layer 60 has been deposited on substrate 61 and has been covered by dielectric layer 64 on which resistive layer 62 lies. Cathode distribution mesh 67, comprised of the same material as resistive layer 62, connects conductive layer 60 to resistive layer 62. Dielectric layer 69 corresponds to dielectric layer 34 in FIG. 3A and the parts of the structure that lie above layer 69 correspond to the parts that lie above layer 34 in FIG. 3A. FIG. 6B is a plan view of part of FIG. 6A showing cathode distribution mesh 67 and via hole 66. As already mentioned, a CMP process is employed to planarize the surface prior to the formation of the microtips.

Preferred materials for manufacturing this embodiment have included silicon, silicon/chrome alloy, indium tin oxide, and tantalum nitride for the resistive layer, laid down to provide a sheet resistance in the range of from $10^7$ to $10^9$ ohms/square and silicon oxide, aluminum oxide, silicon nitride, iron oxide, indium oxide, stannous oxide, and tantalum oxide for the dielectric layers.

FIGS. 7A and 7B and FIGS. 8A and 8B show fifth and sixth embodiments, respectively, that bear the same relationship to FIGS. 6 as do FIGS. 4 and 5 to FIGS. 3. The additional third dielectric layer that is a feature of the fifth and sixth embodiments allows for an even more compact design. Note that layer 71 in FIG. 7 represents a single cathode line. Said cathode line connects to one end of thin film resistor 72 through via hole 77, the other end of resistor 72 being connected to cathode column 75 through via hole 76, as in the earlier embodiments.

Preferred materials for manufacturing this embodiment have included silicon, silicon/chrome alloy, indium tin oxide, and tantalum nitride for the resistive layer, laid down to provide a sheet resistance in the range of from $10^7$ to $10^9$ ohms/square and silicon oxide, aluminum oxide, silicon nitride, iron oxide, indium oxide, stannous oxide, and tantalum oxide for the dielectric layers.

While the invention has been particularly shown and described with reference to the preferred embodiments described above, it will be understood by those skilled in the art that various changes in form and details may be made without departing from the spirit and scope of the invention.

What is claimed is:

1. A method for manufacturing a cold cathode field emission display comprising:

providing an insulating substrate;

depositing a resistive layer onto said substrate;

depositing a cathode distribution mesh onto said resistive layer;

depositing a first dielectric layer onto said resistive layer and onto said cathode distribution mesh;

depositing and then patterning a conductive layer to form cathode columns on said first dielectric layer, disposed so as to underlap said cathode distribution mesh along one dimension;

forming gate lines for said display disposed as parallel, spaced conductors, over, and at an angle to, said cathode columns;

forming via holes through said first dielectric layer, said via holes being centrally located within the interstices of said cathode distribution mesh, thereby enabling conductive material from said cathode columns to connect to said resistive layer;

depositing a second dielectric layer, located between said cathode columns and said gate lines;

forming a plurality of openings, located at the intersections of said cathode columns and said gate lines and passing through said gate lines and said second dielectric layer;

planarizing the surface of said display; and then forming a plurality of cone shaped field emission microtips, each centrally located within one of the openings, the base of each of said microtips being in contact with said conductive layer and the apex of each microtip being in the same plane as that of said gate lines.

2. The method of claim 1 wherein said planarization step is achieved by means of Chemical Mechanical Polishing.

* * * * *